US008846158B2

(12) United States Patent
Jiang

(10) Patent No.: US 8,846,158 B2
(45) Date of Patent: Sep. 30, 2014

(54) METHOD FOR DEPOSITING FUNCTIONAL PARTICLES IN DISPERSION AS COATING PREFORM

(71) Applicant: NanoMech, Inc., Fayetteville, AR (US)

(72) Inventor: Webping Jiang, Fayetteville, AR (US)

(73) Assignee: NanoMech, Inc., Fayetteville, AR (US)

( * ) Notice: Subject to any disclaimer, the term of this patent is extended or adjusted under 35 U.S.C. 154(b) by 0 days.

(21) Appl. No.: 13/746,182

(22) Filed: Jan. 21, 2013

(65) Prior Publication Data

US 2013/0189443 A1 Jul. 25, 2013

Related U.S. Application Data

(60) Provisional application No. 61/589,073, filed on Jan. 20, 2012.

(51) Int. Cl.

| | |
|---|---|
| ***B05D 1/06*** | (2006.01) |
| ***B05D 1/00*** | (2006.01) |
| ***C23C 24/00*** | (2006.01) |

(52) U.S. Cl.

CPC ..... *B05D 1/007* (2013.01); *C23C 24/00* (2013.01)

USPC ..... 427/475; 427/483

(58) Field of Classification Search

USPC ..... 427/475, 483

See application file for complete search history.

(56) References Cited

U.S. PATENT DOCUMENTS

| | | | | |
|---|---|---|---|---|
| 6,764,720 | B2 * | 7/2004 | Pui et al. | 427/479 |
| 2004/0023035 | A1 | 2/2004 | Brandon et al. | |
| 2011/0033609 | A1 | 2/2011 | Jiang et al. | |

FOREIGN PATENT DOCUMENTS

| | | | |
|---|---|---|---|
| EP | 1699886 | B1 | 2/2008 |
| WO | 2008/051433 | * | 5/2008 |

OTHER PUBLICATIONS

PCT International Search Report and Written Opinion for PCT/US2013/022422.

* cited by examiner

*Primary Examiner* — Frederick Parker

(57) ABSTRACT

A method of depositing particles onto a substrate utilizes a liquid dispersant into which the particles are introduced prior to spraying upon the surface. The ratio of the particles to the dispersant, as well as the volume of the dispersant, may be used to control the density of the particles that result on the substrate after spraying.

16 Claims, 2 Drawing Sheets

METHOD FOR DEPOSITING FUNCTIONAL PARTICLES IN DISPERSION AS COATING PREFORM

CROSS-REFERENCE TO RELATED APPLICATIONS

This application claims the benefit of U.S. provisional patent application No. 61/589,073, filed on Jan. 20, 2012, and entitled "Method for Depositing Functional Particles in Dispersion as Coating Preform." Such application is incorporated herein by reference in its entirety.

STATEMENT REGARDING FEDERALLY SPONSORED RESEARCH OR DEVELOPMENT

Not applicable.

BACKGROUND OF THE INVENTION

Particle coating preform, such as used in the coating of cutting tools and many other technologies, can be deposited using a variety of technologies. These existing technologies, however, are either limited by the difficulty in scaling up or challenges related to edge coverage and controlling particle density and agglomeration. What is desired is a scalable method for large-scale realization of particle coating preform with good edge coverage, controlled particle density, and reduced agglomeration.

References mentioned in this background section are not admitted to be prior art with respect to the present invention.

BRIEF SUMMARY OF THE INVENTION

The present invention is directed to a method of coating, which may be stand-alone or combined with other processes, providing functional particle-based coating with a desired thickness and properties for, by way of example, cutting tools, machining, and wear-resistant applications.

In a first aspect, the invention is directed to a method for fabricating functional particles in dispersion, comprising the steps of mixing particles comprising (A) a plurality of cubic boron nitride (cBN) particles or diamond particles, or (B) a mixture of a plurality of cBN particles or diamond particles and other particles selected from the group consisting of nitrides, carbides, carbonitrides, borides, oxides, and metallic phases with functional or non-functional dispersants in different percentage, applying chemical, mechanical, or chemo-mechanical methods and followed by ultrasound energy, if needed, to agitate and disperse the particles for a homogeneous dispersion, and applying electrical bias to form the coating preform, wherein the electrical bias can be applied to substrates or particle dispersion.

In a second aspect, the invention is directed to a coating preform layer of material, comprising cubic boron nitride (cBN) particles or diamond particles, and other particles selected from the group consisting of nitrides, carbides, carbonitrides, borides, oxides, and metallic phases, and wherein the particle size may be in the range of, but not limited to, a few nanometers to a few hundreds of nanometers, and up to 10 microns and further the thickness of the layer ranges from a few nanometers up to a few thousand microns.

In a third aspect, the invention is directed to a coated material, comprising cubic boron nitride (cBN) particles or diamond particles and other particles in a mixture with the cBN particles or diamond particles to form a composite coating preform layer, the other particles selected from the group consisting of nitrides, carbides, carbonitrides, borides, oxides, and metallic phases, and a block beneath the composite coating preform layer, wherein the layer thickness ranges from a few nanometers up to a few thousand microns These and other features, objects and advantages of the present invention will become better understood from a consideration of the following detailed description of the preferred embodiments and appended claims in conjunction with the drawings as described following:

DETAILED DESCRIPTION OF THE PREFERRED EMBODIMENT(S)

Before the present invention is described in further detail, it should be understood that the invention is not limited to the particular embodiments described, and that the terms used in describing the particular embodiments are for the purpose of describing those particular embodiments only, and are not intended to be limiting, since the scope of the present invention will be limited only by the claims.

Figure 1:
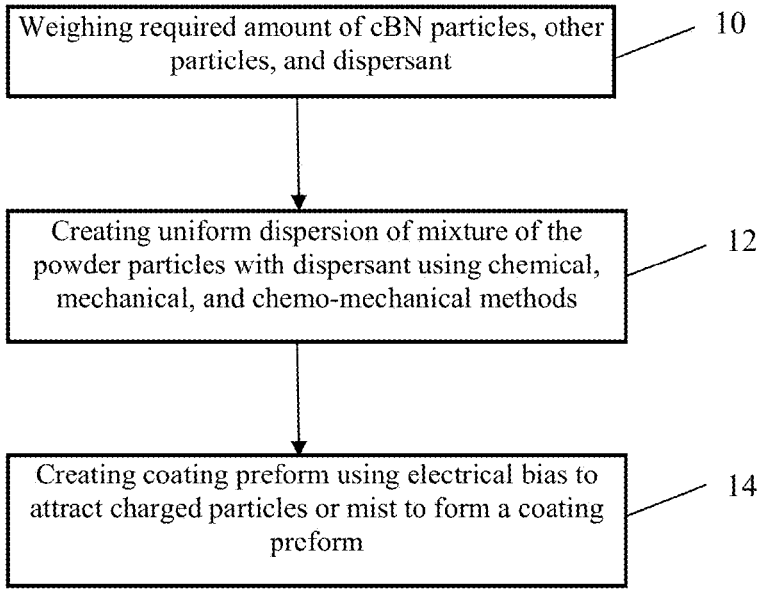
FIG. 1 is a flow chart illustrating a process according to a preferred embodiment of the present invention.
Figure 2:
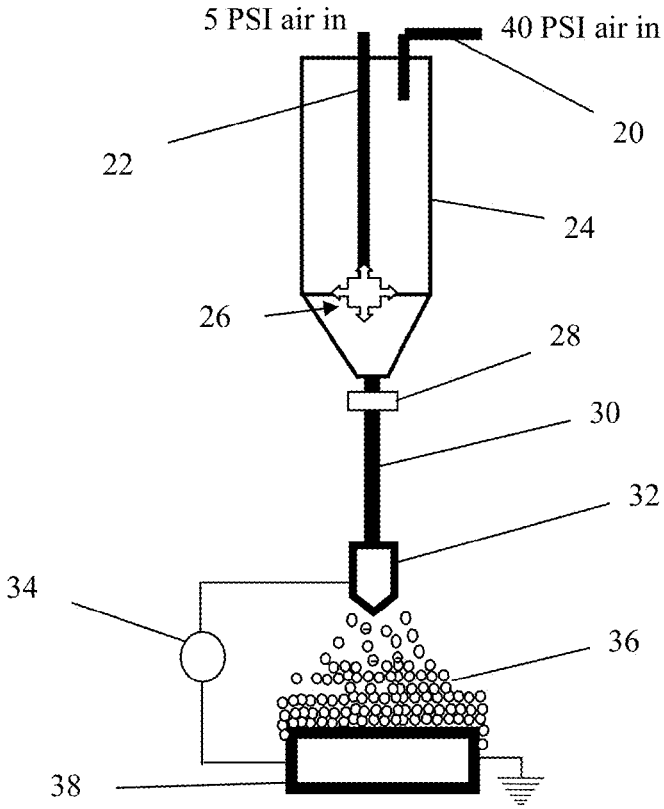
FIG. 2 is a schematic diagram illustrating an apparatus for performing a process according to a preferred embodiment of the present invention.

With reference to FIGS. 1-2, the preferred embodiment of the present invention may be described. This preferred embodiment of the invention relates to the deposition of particles, for example, cBN or diamond particles, dispersed in a liquid medium to form a preform in mono-phase and/or multiple-phases with tunable particle density and surface morphology, by applying the mechanism of charged particles or mists attracted by, for example, electrical bias, to direct the particles to a substrate. The particle size may be in the range of, but not limited to, a few nanometers to a few hundreds of nanometers, and up to 10 microns. In an example, the dispersant may be a functional reagent, such as surfactants for modifying the surface properties of the particles, or a non-functional reagent, such as methanol and ethanol, in single constituent or multiple constituents. The dispersion can be created readily by chemical, mechanical, and chemo-mechanical methods in a variety of solid to dispersant ratios. The thickness of the preform and the density of the particles can be controlled by adjusting the volume of the dispersion and the ratio of particle to dispersant. This deposition process offers flexibility to create (a) a particle coating preform in single constituent or multiple constituents with a predicable density; (b) particle coating preform of different thicknesses; (c) particle coating preform with excellent coverage of edges of different shapes and dimensions; and (d) elemental gradient particle coating preform with a desired binder. The process presents an opportunity for manufacturing particle-based composite coatings for wear-resistance and other applications.

The invention is preferably realized using a particle charging process for spraying the particles in dispersion. Such processes are disclosed, for example, in U.S. Pat. No. 6,607,782, and in U.S. Published Patent Application No. 2011/0033631, the disclosures of which are incorporated herein by reference. Applications include but are not limited to cutting tools, wear-resistant parts, erosion and corrosion protection, and thermal protection.

Turning to FIG. 1 in particular, the process according to a preferred embodiment begins with a first step of quantifying the required amount of cBN particles or diamond particles of one size or different size, surfactants, and dispersant in a certain ratio based on the desired particle concentration. At step 12, the quantified particles, surfactants if needed, and dispersant will be placed in a container and mixed together uniformly by mechanical methods such as agitation using mechanical mixer or ball milling, chemical methods, chemo-mechanical methods including a mechanical attrition process, and ultrasound energy. The particle dispersion will then be translated to a deposition system, which can either charge the particles or apply an electrical bias to the substrate, and be deposited as a coating preform, at step 14.

FIG. 2 illustrates an apparatus for an example embodiment applying the dispersion as coating preform using electrical bias. Air-tight container 24 receives low-pressure air at low-pressure inlet 22 and high-pressure air at high-pressure inlet 20. In the preferred embodiment, the pressure of low-pressure air at low-pressure inlet 22 is about 5 psi, and the pressure of high-pressure air at high-pressure inlet 20 is about 40 psi. Low-pressure inlet 22 delivers air directly to air-driven mixer 26. Control valve 28 provides control of the delivery of the mixture through delivery tube 30 to sprayer 32. Sprayer 32 distributes particles 36 to form the preform on substrate 38. In this embodiment, source of electrical bias 34 provides the necessary electrical charging. The result is a substrate 38 coated with particles 36.

In a particular example according to a preferred embodiment beginning with a first step 10 as illustrated in FIG. 1 utilizing cBN particles, the required amount of cBN particles (<2 μm diameter), surfactant (Atlox 4913), and isopropyl alcohol (IPA) in the ratio of 1:12.5 (cBN particles/IPA), and of 1:15.5 (surfactant/IPA), respectively, is mixed to create a dispersion with 10.7% cBN particles. The quantified particles and dispersant will be placed in a container, preferably, glass beaker or metal container, and mixed together uniformly by using pulsed ultrasound energy. The details of the processing parameters for making the aforesaid dispersion are listed in Table 1.

TABLE 1

| Processing parameter | Setting of the parameter |
|---|---|
| Dispersant | Isopropyl alcohol (IPA) |
| Ratio of cBN particles/IPA | 1:12.5 |
| Ratio of surfactant/IPA | 1:15.5 |
| Power of ultrasound energy, W | 350 |
| Amplitude | 100% |
| Pulse on, s | 15 |
| Pulse off, s | 5 |
| Total time, min | 15 |

Figure 3:
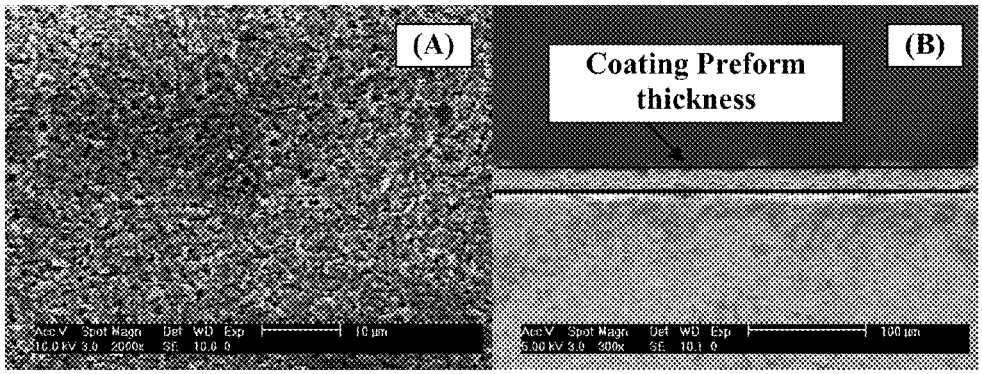
FIG. 3 is a set of micrographs showing a coating produced according to a preferred embodiment of the present invention.

The uniformly mixed solution is then translated to an air-tightened metallic container 24, as shown in FIG. 2, with mechanical agitation created by a pressure-driven mixer, and deposited by applying the mechanism of charged particles or mists attracted by, for example, electrical bias (−10 kV~−120 kV), as illustrated in FIG. 2, to direct the particles from sprayer 32 to substrate 38 to form a particle preform. The results of this process are shown in the micrographs of FIG. 3 denoted (A) and (B), being views of the resulting coating at magnifications of 2000× and 300×, respectively. The thickness of the preform ranges from a few tens of nanometers up to a few thousand microns, depending on the particle size, and can be changed by adjusting the volume of the dispersion deposited. The density of the preform can be tailored by combining particles of different size distributions and the particle concentration of the dispersion, while the composition gradient can be adjusted by multiple deposition heads or nozzles with different particle dispersion at different deposition rates.

Certain ranges may have been provided in the description of these particular embodiments with respect to certain parameters. When a range of values is provided, it should be understood that each intervening value between the upper and lower limit of that range and any other stated or intervening value in that stated range is encompassed within the invention, subject to any specifically excluded limit in the stated range. Where the stated range of values includes one or both of the limits, ranges excluding either or both of those limits are also included in the scope of the invention.

Unless otherwise stated, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It will be apparent to those skilled in the art that many more modifications are possible without departing from the inventive concepts herein.

All terms used herein should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. As used herein, "consisting of" excludes any element, step, or ingredients not specified in the claim element. As used herein, "consisting essentially of" does not exclude materials or steps that do not materially affect the underlying novel characteristics of the claim. When a Markush group or other grouping is used herein, all individual members of the group and all combinations and subcombinations possible of the group are intended to be individually included in the disclosure. All references cited herein are hereby incorporated by reference to the extent that there is no inconsistency with the disclosure of this specification.

The present invention has been described with reference to certain preferred and alternative embodiments that are intended to be exemplary only and not limiting to the full scope of the present invention as set forth in the appended claims.

The invention claimed is:

1. A method for depositing particles, the method comprising the steps of:

a. dispersing the particles in a liquid dispersant medium to produce a homogeneous dispersion, wherein the dispersion step comprises the application of at least one of mechanical, chemical, chemo-mechanical, and ultrasound dispersion energy, and wherein a ratio of the particles to the liquid dispersant medium is set according to a desired coating density;

b. introducing the liquid dispersant medium to a container attached to and feeding a sprayer;

c. applying an electrical bias between the substrate and the sprayer; and d. spraying the liquid dispersant medium onto the substrate to form a substrate coated with the particles at the desired coating density.

2. The method of claim 1, wherein the spraying step comprises the step of applying an electrostatic field to the particles to charge the particles.

3. The method of claim 1, wherein the particles are of a diameter in the range of 1 nm up to 10 μm.

4. The method of claim 3, wherein the particles are of a diameter up to 100 nm.

5. The method of claim 1, wherein the liquid dispersant medium comprises multiple liquid constituents.

6. The method of claim 5, wherein the liquid dispersant medium comprises a surfactant.

7. The method of claim 1, wherein the step of dispersing the particles in a liquid dispersant medium further comprises the step of setting the volume of the dispersion according to a desired coating particle density.

8. The method of claim 1, wherein the particles comprise at least one of cBN particles and diamond particles.

9. The method of claim 1, wherein a first portion of the particles are formed of a first material, and a second portion of the particles are formed of a second material different from the first material.

10. The method of claim 1, wherein the particles comprise materials selected from the group consisting of nitrides, carbides, carbonitrides, borides, oxides, and metallic phases.

11. The method of claim 9, wherein the particles formed of the first material are of a different size than the particles formed of the second material.

12. The method of claim 1, wherein the particles comprise a first set of particles of a first diameter and a second set of particles of a second diameter, and wherein a ratio of the first set of particles to the second set of particles corresponds to a desired coating density.

13. The method of claim 1, further comprising the steps of introducing high-pressure gas into the container at a high-pressure gas inlet, and simultaneously introducing low-pressure gas into the container at a low-pressure gas inlet.

14. The method of claim 13, further comprising the step of directing the low-pressure gas from the low-pressure gas inlet to a mixer within the container.

15. The method of claim 13, wherein the high-pressure gas is introduced at a pressure of about 40 psi.

16. The method of claim 15, wherein the low-pressure gas is introduced at a pressure of about 5 psi.

* * * * *